United States Patent [19]

Masumoto et al.

[11] 4,440,720

[45] Apr. 3, 1984

[54] MAGNET ALLOY USEFUL FOR A MAGNETIC RECORDING AND REPRODUCING HEAD AND A METHOD OF MANUFACTURING THEREOF

[75] Inventors: Hakaru Masumoto, Sendai; Yuetsu Murakami, Izumi, both of Japan

[73] Assignee: The Foundation: The Research Institute of Electric and Magnetic Alloys, Sendai, Japan

[21] Appl. No.: 300,586

[22] Filed: Sep. 9, 1981

[30] Foreign Application Priority Data

Dec. 16, 1980 [JP] Japan ..... 55-177682

[51] Int. Cl.[3] ..... C22C 19/03

[52] U.S. Cl. ..... 420/459; 420/441; 420/442; 420/457; 420/460; 148/31.55; 148/121

[58] Field of Search ..... 148/121, 31.55; 75/170; 420/441, 442, 443, 445, 446, 447, 448, 449, 450, 451, 452, 453, 455, 457, 459, 460

[56] References Cited

U.S. PATENT DOCUMENTS

| | | | |
|---|---|---|---|
| 1,910,309 | 5/1933 | Smith et al. | 148/121 |
| 2,289,566 | 7/1942 | Adamoli | 75/170 |
| 3,343,949 | 9/1967 | Wikle | 75/170 |
| 3,743,550 | 7/1973 | Masumoto et al. | 148/31.55 |
| 3,807,992 | 4/1974 | Komatsu et al. | 75/170 |
| 3,837,933 | 9/1974 | Masumoto et al. | 148/121 |

*Primary Examiner*—John P. Sheehan

*Attorney, Agent, or Firm*—Parkhurst & Oliff

[57] ABSTRACT

A magnet alloy useful for a magnetic recording and reproducing head consist of by weight of 70 to 86% of nickel, more than 1% and less than 14% of niobium, and 0.001 to 3% of beryllium as main ingredients and 0.01 to 10% of total amount of subingredients selected from the group consisting of not more than 8% of molybdenum, not more than 7% of chromium, not more than 10% of tungsten, not more than 7% of titanium, not more than 7% of vanadium, not more than 10% of manganese, not more than 7% of germanium, not more than 5% of zirconium, not more than 2% of rare earth metal, not more than 10% of tantalum, not more than 1% of boron, not more than 5% of aluminum, not more than 5% of silicon, not more than 5% of tin, not more than 5% of antimony, not more than 10% of cobalt and not more than 10% of copper, a small amount of impurities and the remainder iron and having initial permeability of more than 3,000, maximum permeability of more than 5,000, and Vickers hardness of more than 130.

8 Claims, 2 Drawing Figures

MAGNET ALLOY USEFUL FOR A MAGNETIC RECORDING AND REPRODUCING HEAD AND A METHOD OF MANUFACTURING THEREOF

BACKGROUND OF THE INVENTION

1. Field of the Invention

This invention relates to an alloy having high permeability and consisting essentially of 70–86% of nickel, more than 1% and less than 14% of niobium, 0.001–3% of beryllium, a small amount of impurities and the remainder iron, or an alloy having high permeability and consisting essentially of 70–86% of nickel, more than 1% and less than 14% of niobium and 0.001–3% of beryllium the remainder iron and a small amount of impurity, as main ingredients and 0.01–10% of total amount of subingredients selected from the group consisting of not more than 8% of molybdenum, not more than 7% of chromium, not more than 10% of tungsten, not more than 7% of titanium, not more than 7% of vanadium, not more than 10% of manganese, not more than 7% of germanium, not more than 5% of zirconium, not more than 2% of rare earth metal, not more than 10% of tantalum, not more than 1% of boron, not more than 5% of aluminum, not more than 5% of silicon, not more than 5% of tin, not more than 5% of antimony, not more than 10% of cobalt and not more than 10% of copper. An object of the invention is to provide a magnetic alloy having high permeability, high hardness, and further excellent forgeability and workability for the use of magnetic recording and reproducting head.

2. Description of the Prior Art

Nowadays, as a magnetic material of audio magnetic recording and reproducing heads, Permalloy (Ni-Fe series alloy) having high permeability and high workability is generally used, but its hardness is about 110 of low value of Vickers hardness (Hv) and its anti-abrasive property is very low, accordingly, it is an important problem to improve such anti-abrasive property and hardness in said magnetic material for the use of audio magnetic recording and reproducing heads.

The inventors have disclosed in U.S. Pat. No. 3,743,550 and U.S. Pat. No. 3,837,933 that an Ni-Fe-Nb alloy adding Mo, Cr, W, V, Ta, Mn, Ge, Ti, Zr, Al, Si, Sn, Co and Cu thereto has high permeability, high hardness and excellent anti-abrasive property.

The inventors have continued to study an Ni-Fe-Nb-Be alloy prepared by adding niobium and beryllium simultaneously to an Ni-Fe alloy, and found that the Ni-Fe-Nb-Be alloy has high hardness and excellent anti-abrasive property and is suitable as a magnetic alloy for the use of magnetic head owing to a synergic effect of both solid-solution hardening by addition of niobium and precipitation hardening by addition of beryllium. The inventors have further made investigations and experiments on the Ni-Fe-Nb-Be alloy by adding less than 0.01–10% of total amount of subingredient of at least one element selected from the group consisting of molybdenum (Mo), chromium (Cr), tungsten (W), titanium (Ti), vanadium (V), manganese (Mn), germanium (Ge), zirconium (Zr), rare earth metal, tantalum (Ta), boron (B), aluminum (Al), silicon (Si), tin (Sn), antimony (Sb), cobalt (Co) and copper (Cu), and finally found alloys having superior magnetic properties of high permeability, high hardness, high forgeability and high workability.

SUMMARY OF THE INVENTION

An object of the invention is to provide Ni-Fe-Nb-Be series alloy containing by weight 70–86% of nickel, more than 1% and less than 14% of niobium, 0.001–3% of beryllium, a small amount of impurity and the remainder iron, or Ni-Fe-Nb-Be series alloy containing by weight 70–86% of nickel, more than 1% and less than 14% of niobium and 0.001–3% of beryllium and the remainder iron and a small amount of impurity as a main ingredient, and by weight 0.01–10% in total amount of subingredient of at least one element selected from the group consisting of not more than 8% of molybdenum, not more than 7% of chromium, not more than 10% of tungsten, not more than 7% germanium, not more than 5% of zirconium, not more than 2% of rare earth metal, not more than 10% of tantalum, not more than 1% of boron, not more than 5% of aluminum, not more than 5% of silicon, not more than 5% of tin, not more than 5% of antimony, not more than 10% of cobalt and not more than 10% of copper, and having high permeability, high hardness, high forgeability and high workability, such as high initial permeability of more than 3,000, maximum permeability of more than 5,000 and Vickers hardness of more than 130, so as to provide a high permeability magnetic alloy which is available to magnetic recording and reproducing head by simple heat treatment.

A preferable range of the composition in the present invention is as follows. That is, it is most preferable to use the alloy consisting of 73–85% of nickel, more than 1% and less than 10% of niobium and 0.01–2% of beryllium, and the remainder iron and a small amount of impurity as a main ingredient and not more than 0.01–10% of total amount of subingredients of at least one element selected from the group consisting of not more than 6% of molybdenum, not more than 5% of chromium, not more than 7% of tungsten, not more than 5% of titanium, not more than 4% of vanadium, not more than 7% of manganese, not more than 3% of zirconium, not more than 1% of rare earth metal, not more than 7% tantalum, not more than 0.7% of boron, not more than 3% of aluminum, not more than 3% of silicon, not more than 3% of tin, not more than 3% of antimony, not more than 7% of cobalt and not more than 7% of copper.

Further, the alloy having the above composition is heated at a high temperature of more than a recrystallization temperature, (i.e., more than about 600° C., preferably more than 800° C.) and lower than a melting point, in a nonoxidizing atmosphere or vacuum for at least more than 1 minute and less than about 100 hours corresponding to the composition, sufficiently heated at a high temperature so as to homogenize the structure thereof, removed from a strain caused by working, thereafter cooled to a temperature close to the order-disorder transformation point of about 600° C., maintained at the same temperature for a short time to make every portion of the structure a uniform temperature, then cooled to a room temperature from the temperature of more than the above transformation point, or further heated at a temperature of less than the order-disorder transformation point (i.e. about 600° C.) for more than 1 minute and less than about 100 hours corresponding to the composition and cooled, so as to obtain the magnetic alloy having high permeability and high hardness.

The above cooling range from said high heating temperature to a temperature more than the order-disorder transformation point i.e. about 600° C. does not influence on magnetic property of the thus obtained alloy even by quenching or slow cooling, but the cooling rate at a temperature of less than the transformation point has a great influence upon the magnetic property. That is, if the cooling is carried out from a temperature of more than the transformation point to a room temperature at a suitable cooling rate of 100° C./second to 1° C./hour corresponding to the composition, the degree of order usually becomes about 0.1–0.6 and the excellent magnetic property can be obtained. Particularly, when the cooling is carried out at a cooling rate close to 100° C./second among the above described cooling rate, the degree of order becomes about 0.1, and if the cooling rate is elevated more than 100° C./second, the degree of the order is not shifted anymore but becomes smaller and the magnetic property is deteriorated. However, when the alloy having such a small degree of order is reheated at a temperature of less than the transformation point of 200° C.–600° C., the degree of order is shifted to 0.1–0.6 and the magnetic property is improved. On the other hand, if the cooling is slowly carried out from a temperature of more than the above transformation point at a cooling rate of 1° C./hour, the degree of order is shifted too fast to about 0.6 or more and the magnetic property is deteriorated.

In short, in the alloy having the composition according to the present invention, the excellent magnetic property can be obtained by heating for a sufficient time at more than 600° C., preferably more than 800° C. and less than the melting point, cooling at a suitable speed, and regulating the degree of order between 0.1–0.6. When the cooling is too fast and the degree of order becomes too small, if the alloy is reheated at a temperature of lower than the order-disorder transformation point i.e. between 200° C.–600° C., the degree of order is adjusted to a suitable range of 0.1–0.6 and the magnetic property is remarkably improved.

Generally speaking, if the temperature of a heat treatment is high, the time of the heat treatment is short, and if the temperature of a heat treatment is low, the time of the heat treatment should be lengthened. Further, in case of a large volume of alloy, the time of the heat treatment is lengthened and in case of a small volume of alloy, the time of the heat treatment is naturally shortened.

The cooling rate from about 600° C. to a room temperature in order to obtain the highest permeability of each alloy according to the present invention is fairly different in accordance with the composition of each alloy, but the speed such as the cooling rate in a furnace, i.e., slow cooling, is advantageous in practical application. For instance, in case of manufacturing a magnetic recording and reproducing head, the heat treatment for removing strains produced after forming and working is preferably carried out in a non-oxidizing atmosphere or vacuum in order to maintain the configuration of a product and to avoid any formation of oxide on the surface thereof, so that the alloy according to the present invention, which exhibits the excellent characteristic features by slow cooling, is suitable for such heat treatment.

The process for the production of the alloy according to the present invention will be explained in detail in order.

At first, in order to prepare the alloy according to the present invention, a definite amount by weight of 70–86% of nickel, more than 1% and not more than 14% of niobium, 0.001–3% of beryllium and the remainder iron as a main ingredient are melted in air, preferably in a non-oxidizing atmosphere or in vacuum, with the use of a suitable melting furnace, thereto added manganese, silicon, aluminum, titanium, boron, calcium alloys, magnesium alloys and a small amount of other deoxidizing agent and desulfurizing agent so as to remove impurity as far as possible, and further added a definite amount of 0.01–10% by weight in total of at least one element selected from the group consisting of less than 8% of molybdenum, less than 7% of chromium, less than 10% of tungsten, less than 7% of titanium, less than 7% of vanadium, less than 10% of manganese, less than 7% of germanium, less than 5% of zirconium, less than 2% of rare earth metal, less than 10% of tantalum, less than 1% of boron, less than 5% of aluminum, less than 5% of silicon, less than 5% of tin, less than 5% of antimony, less than 10% of cobalt and less than 10% of copper, all the substances thus added are sufficiently stirred to provide a molten alloy having homogeneous solid solution. Next, the thus obtained molten alloy is poured into a mold having a desired shape and size to provide a sound ingot. This ingot is further applied to a forming processing such as forging or rolling at a room temperature or a high temperature, to make an article of a desired shape, for instance, a thin sheet of 0.3 mm thickness. This thin sheet is punched to obtain a desired shape and size, and the thus punched sheet is heated in hydrogen or other suitable non-oxidizing atmosphere or in vacuum at a temperature of more than a recrystallization temperature, i.e., more than 600° C., preferably more than 800° C. and less than the melting point, for more than 1 minute and less than about 100 hours, and cooled at a suitable speed of 100° C./second to 1° C./hour, preferably 10° C./second to 1° C./hour corresponding to the composition. The sheet is further re-heated at a temperature of 200°–600° C. for more than 1 minute and less than about 100 hours for tempering and cooled.

BRIEF DESCRIPTION OF THE DRAWINGS

For a better understanding of the present invention, reference is made of the accompanying drawings, in which.

DESCRIPTION OF THE PREFERRED EMBODIMENTS

Figure 1:
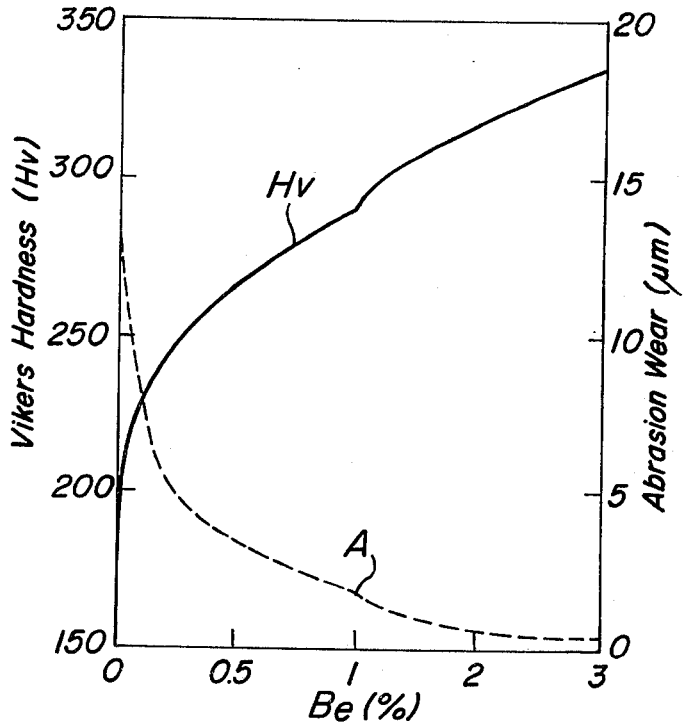
FIG. 1 is a graph showing the relation of a content of beryllium, a hardness and an abrasion wear of 79.5% Ni-Fe-7% Nb-Be alloy.

For a better understanding of the present invention reference is made of the following embodiments.

EXAMPLE 1

Alloy No. 23 (composition: Ni=79.7%, Fe=13.1%, Nb=7.0%, Be=0.2%)

As a starting material, 99.8% of pure electrolytic nickel, 99.9% of pure electrolytic iron, 99.8% of pure niobium, and 99.8% of pure beryllium were used. At the outset for preparing a sample, 800 g of the total amount of the starting material were charged into an alumina crucible and melted in a high frequency induction electric furnace in vacuum, and thereafter stirred and mixed with each other so as to obtain a homogeneous molten alloy. The thus obtained melt was poured into an iron mold having a hole of 25 mm diameter and 170 mm height, and the resulted ingot was forged at a temperature of about 1,000° C. so as to make a plate of about 7 mm thick. The plate was further hot-rolled to a plate of about 1 mm thick at a temperature of about 600° C.–900° C., cold rolled at a room temperature to a thin plate of about 0.1 mm, and punched out a ring plate having 44 mm in outer diameter and 36 mm in inner diameter and a core for a magnetic head. Various heat treatments were applied to these cores and ring plates as shown in Table 1, the characteristic features and hardness of the ring plate were measured, while a magnetic head was manufactured with the use of the core and an abrasion wear of the magnetic head was measured by a Tulysurf surface roughness tester after running a magnetic tape for 300 hours, and the results were obtained as shown in Table 1.

TABLE 1(a)

| Heat treatment | Initial permeability μo | Maximum permeability μm | Effective permeability μe (1 KHz) | Residual magnetic flux density (G) | Coercive force (Oe) | Saturated magnetic flux density (G) | Vickers hardness Hv | Abrasion wear (μm) |
|---|---|---|---|---|---|---|---|---|
| After heated in hydrogen at 700° C. for 10 hrs, cooled to 600° C. in furnace and further cooled to room temperature at speed of 1200° C./hr. | 17400 | 63000 | 15400 | 2350 | 0.0235 | 7010 | 275 | 2.5 |
| After said heat treatment, further heated in vacuum at 400° C. for 30 min. | 22500 | 81000 | 17600 | 2320 | 0.0194 | 7030 | 283 | 2.3 |
| After heated in hydrogen at 900° C. for 5 hrs, cooled to 600° C. in furnace and further cooled to room temperature at speed of 800° C./hr. | 30600 | 128000 | 18300 | 2270 | 0.0171 | 7050 | 246 | 7.4 |
| After said heat treatment, further heated in vacuum at 400° C. for 1 hr. | 41700 | 145200 | 19700 | 2300 | 0.0150 | 7070 | 252 | 7.0 |
| After heated in hydrogen at 1050° C. for 3 hrs, cooled to 600° C. in furnace and further cooled to room temperature at speed of 600° C./hr. | 52000 | 147000 | 20800 | 2250 | 0.0126 | 7080 | 237 | 8.2 |

TABLE 1(b)

| Heat treatment | Initial permeability μo | Maximum permeability μm | Effective permeability μe (1 KHz) | Residual magnetic flux density (G) | Coercive force (Oe) | Saturated magnetic flux density (G) | Vickers hardness Hv | Abrasion wear (μm) |
|---|---|---|---|---|---|---|---|---|
| After said heat treatment, further heated in vacuum at 400° C. for 30 min. | 63300 | 179000 | 21200 | 2280 | 0.0110 | 7080 | 245 | 7.5 |
| After heated in hydrogen at 1150° C. for 2 hrs, cooled to 600° C. in furnace and further cooled to room temperature at speed of 1200° C./hr. | 46300 | 132400 | 19850 | 2230 | 0.0138 | 7090 | 240 | 7.9 |
| After said heat treatment, further heated in vacuum at 400° C. for 1 hr. | 68400 | 182000 | 20100 | 2250 | 0.0102 | 7100 | 246 | 7.3 |
| After heated in hydrogen at 1250° C. for 2 hrs, cooled to 600° C. in furnace and further cooled to room temperature at speed of 400° C./hr. | 72000 | 213800 | 20500 | 2270 | 0.0085 | 7120 | 240 | 7.8 |
| After said heat treatment, further heated in vacuum at 400° C. for 1 hr. | 58300 | 151000 | 21000 | 2300 | 0.0117 | 7100 | 247 | 7.2 |

EXAMPLE 2

Alloy No. 52 (composition: Ni=79.5%, Fe=11.7%, Nb=6.0%, Be=0.3%, Mo=2.5%)

As a starting material, nickel, iron, niobium and beryllium having the same purity as in Example 1 and 99.9% of pure molybdenum were used. The method for preparing a sample was the same as in Example 1. Various heat treatments were applied to the sample and the characteristic features as shown in Table 2 were obtained.

TABLE 2(a)

| Heat treatment | Initial permeability μo | Maximum permeability μm | Effective permeability μe (1 KHz) | Residual magnetic flux density (G) | Coercive force (Oe) | Saturated magnetic flux density (G) | Vickers hardness Hv | Abrasion wear (μm) |
|---|---|---|---|---|---|---|---|---|
| After heated in hydrogen at 900° C. for 5 hrs, cooled to 600° C. in | 53000 | 207000 | 21400 | 2230 | 0.0072 | 6070 | 282 | 1.4 |

TABLE 2(a)-continued

| Heat treatment | Initial permeability μo | Maximum permeability μm | Effective permeability μe (1 KHz) | Residual magnetic flux density (G) | Coercive force (Oe) | Saturated magnetic flux density (G) | Vickers hardness Hv | Abrasion wear (μm) |
|---|---|---|---|---|---|---|---|---|
| furnace and further cooled to room temperature at speed of 240° C./hr. | | | | | | | | |
| After said heat treatment, further heated in vacuum at 400° C. for 30 min. | 64000 | 225000 | 34700 | 2250 | 0.0050 | 6090 | 290 | 1.1 |
| After heated in hydrogen at 1150° C. for 2 hrs, cooled to 600° C. in furnace and further cooled to room temperature at speed of 800° C./hr. | 61900 | 226500 | 31300 | 2360 | 0.0053 | 6080 | 255 | 4.9 |
| After said heat treatment, further heated in vacuum at 400° C. for 2 hrs. | 92400 | 315000 | 33800 | 2400 | 0.0034 | 6120 | 260 | 4.2 |
| After heated in hydrogen at 1250° C. for 2 hrs, cooled to 600° C. in furnace and further cooled to room temperature at speed of 100° C./hr. | 118000 | 352000 | 38600 | 2530 | 0.0032 | 6270 | 256 | 4.7 |

TABLE 2(b)

| Heat treatment | Initial permeability μo | Maximum permeability μm | Effective permeability μe (1 KHz) | Residual magnetic flux density (G) | Coercive force (Oe) | Saturated magnetic flux density (G) | Vickers hardness Hv | Abrasion wear (μm) |
|---|---|---|---|---|---|---|---|---|
| After said heat treatment, further heated in vacuum at 400° C. for 1 hr. | 84200 | 270000 | 36200 | 2550 | 0.0035 | 6250 | 270 | 2.8 |
| After heated in hydrogen at 1250° C. for 2 hrs, cooled to 600° in furnace and further cooled to room temperature at speed of 100° C./hr. | 102000 | 324000 | 35000 | 2600 | 0.0035 | 6250 | 250 | 4.5 |
| After said heat treatment, further heated in vacuum at 400° C. for 1 hr. | 91500 | 316000 | 32200 | 2620 | 0.0033 | 6230 | 256 | 4.5 |
| After heated in hydrogen at 1350° C. for 3 hrs, cooled to 600° C. in furnace and further cooled to room temperature at speed of 240° C./hr. | 88300 | 247000 | 33600 | 2410 | 0.0047 | 6240 | 245 | 4.9 |
| After said heat treatment, further heated in vacuum at 400° C. for 1 hr. | 64000 | 214600 | 33900 | 2450 | 0.0053 | 6200 | 252 | 4.4 |

EXAMPLE 3

Alloy No. 92 (composition: Ni=78.1%, Fe=11.1%, Nb=6.5%, Be=0.3%, W=2.5%, Cr=1.5%)

As a starting material, nickel, iron niobium and beryllium having the same purity as in Example 1 and 99.9% of pure tungsten and 99.8% of pure chromium were used. The method for preparing a sample was the same as in Example 1. The characteristic features as shown in Table 3 were obtained by applying various heat treatments to the sample.

TABLE 3(a)

| Heat treatment | Initial permeability μo | Maximum permeability μm | Effective permeability μe (1 KHz) | Residual magnetic flux density (G) | Coercive force (Oe) | Saturated magnetic flux density (G) | Vickers hardness Hv | Abrasion wear (μm) |
|---|---|---|---|---|---|---|---|---|
| After heated in hydrogen at 700° C. for 10 hrs, cooled to 600° C. in furnace and further cooled to room temperature at speed of 240° C./hr. | 41600 | 126000 | 21700 | 2420 | 0.0155 | 6030 | 253 | 3.8 |
| After said heat treatment, further heated in vacuum at 450° C. for 3 hrs. | 53700 | 161800 | 24200 | 2460 | 0.0094 | 6040 | 260 | 3.0 |
| After heated in hydrogen at 900° C. for 5 hrs, cooled to 600° C. in furnace and further cooled to room temperature at speed of 400° C./hr. | 61300 | 185700 | 26000 | 2350 | 0.0072 | 6050 | 247 | 4.7 |
| After said heat treatment, further heated in vacuum at 400° C. for 5 hrs. | 70600 | 203000 | 27400 | 2370 | 0.0068 | 6060 | 255 | 3.5 |
| After heated in hydrogen at 1050° C. for 3 hrs, cooled to 600° C. in furnace and further cooled to room | 85300 | 224000 | 28600 | 2340 | 0.0062 | 6060 | 238 | 5.5 |

TABLE 3(a)-continued

| Heat treatment | Initial permeability μo | Maximum permeability μm | Effective permeability μe (1 KHz) | Residual magnetic flux density (G) | Coercive force (Oe) | Saturated magnetic flux density (G) | Vickers hardness Hv | Abrasion wear (μm) |
|---|---|---|---|---|---|---|---|---|
| temperature at speed of 240° C./hr. | | | | | | | | |

TABLE 3(b)

| Heat treatment | Initial permeability μo | Maximum permeability μm | Effective permeability μe (1 KHz) | Residual magnetic flux density (G) | Coercive force (Oe) | Saturated magnetic flux density (G) | Vickers hardness Hv | Abrasion wear (μm) |
|---|---|---|---|---|---|---|---|---|
| After said heat treatment, further heated in vacuum at 400° C. for 30 min. | 88200 | 256300 | 29200 | 2380 | 0.0058 | 6060 | 240 | 5.3 |
| After heated in hydrogen at 1150° C. for 5 hrs, cooled to 600° C. in furnace and further cooled to room temperature at speed of 800° C./hr. | 72500 | 175000 | 28500 | 2400 | 0.0065 | 6050 | 231 | 6.0 |
| After said heat treatment, further heated in vacuum at 400° C. for 5 hrs. | 86000 | 273000 | 28700 | 2420 | 0.0061 | 6060 | 235 | 5.8 |
| After heated in hydrogen at 1250° C. for 2 hrs, cooled to 600° C. in furnace and further cooled to room temperature at speed of 240° C./hr. | 88600 | 251700 | 29700 | 2350 | 0.0060 | 6060 | 227 | 7.8 |
| After said heat treatment, further heated in vacuum at 420° C. for 3 hrs. | 107300 | 324700 | 35500 | 2410 | 0.0035 | 6080 | 245 | 4.9 |

Table 4 further shows various characteristic features of typical alloy after heated in hydrogen at 1,250° C. for 2 hours cooled from 600° C. to a room temperature at various speeds or further reheated at a temperature of less than 600° C. and measured at a room temperature.

TABLE 4(a)

| Alloy No. | Composition (%) remainder (Fe) Ni | Nb | Be | Mo | Al | Cooling speed from 600° C. after heating at 1250° C. (°C./hr) | Reheating temperature (°C.) time | Initial permeability μo | Maximum permeability (μm) | Effective permeability μe (1 KHz) | Magnetic residual flux density (G) | Coercive force (Oe) | Saturated magnetic flux density (G) | Vickers hardness Hv | Abrasion wear (μm) |
|---|---|---|---|---|---|---|---|---|---|---|---|---|---|---|---|
| 3 | 78.8 | 1.5 | 1.85 | — | — | 1500 | — | 8300 | 47000 | 7300 | 3750 | 0.0375 | 9200 | 155 | 17.2 |
| 5 | 79.0 | 2.2 | 1.40 | — | — | 1500 | — | 10200 | 66200 | 9050 | 3520 | 0.0284 | 8700 | 163 | 16.0 |
| 7 | 79.2 | 3.3 | 1.05 | — | — | 800 | 400, 2 | 11700 | 77400 | 10700 | 3300 | 0.0235 | 8200 | 165 | 15.3 |
| 15 | 79.4 | 5.0 | 0.35 | — | — | 600 | — | 53000 | 132100 | 18200 | 2850 | 0.0146 | 7550 | 205 | 10.5 |
| 23 | 79.7 | 7.0 | 0.20 | — | — | 400 | — | 72000 | 213800 | 20500 | 2270 | 0.0085 | 7120 | 240 | 7.8 |
| 30 | 80.2 | 10.5 | 0.05 | — | — | 240 | 350, 5 | 95200 | 186000 | 24300 | 2040 | 0.0053 | 6060 | 257 | 3.5 |
| 45 | 79.8 | 9.0 | 0.05 | 1.0 | — | 240 | — | 106500 | 273000 | 32000 | 1910 | 0.0038 | 6100 | 237 | 2.7 |
| 52 | 79.5 | 6.0 | 0.30 | 2.5 | — | 100 | — | 118000 | 352000 | 38600 | 2530 | 0.0032 | 6270 | 242 | 4.7 |
| 61 | 79.4 | 4.5 | 0.50 | 1.5 Cr | 0.7 Zr | 100 | — | 75300 | 226400 | 24200 | 1750 | 0.0093 | 6180 | 250 | 6.3 |
| 73 | 80.5 | 7.0 | 0.5 | 2.5 | — | 100 | — | 74800 | 246000 | 23800 | 2160 | 0.0083 | 6530 | 262 | 3.7 |
| 80 | 81.0 | 3.8 | 0.3 | 3.5 W | 0.8 Ge | 800 | 400, 1 | 86000 | 261500 | 25300 | 2250 | 0.0065 | 6400 | 233 | 11.3 |
| 86 | 78.8 | 3.2 | 0.50 | 6.0 | — | 240 | — | 67300 | 152000 | 21600 | 2330 | 0.0091 | 6560 | 195 | 10.2 |
| 92 | 79.6 | 6.5 | 0.25 | 2.5 Ti | 0.9 Ta | 240 | 420, 3 | 87300 | 304700 | 32500 | 2410 | 0.0045 | 6180 | 225 | 10.9 |
| 99 | 80.7 | 8.0 | 0.45 | 2.0 | — | 800 | — | 37500 | 121000 | 18400 | 2370 | 0.0158 | 5730 | 265 | 3.5 |
| 106 | 79.7 | 3.5 | 0.15 | 1.5 | 0.8 | 400 | — | 68200 | 204100 | 24300 | 2450 | 0.0095 | 7100 | 228 | 8.0 |

TABLE 4(b)

| Alloy No. | Composition (%) remainder (Fe) Ni | Nb | Be | V | Sc | Cooling speed from 600° C. after heating at 1250° C. (°C./hr) | Reheating temperature (°C.) time | Initial permeability μo | Maximum permeability (μm) | Effective permeability μe (1 KHz) | Magnetic residual flux density (G) | Coercive force (Oe) | Saturated magnetic flux density (G) | Vickers hardness Hv | Abrasion wear (μm) |
|---|---|---|---|---|---|---|---|---|---|---|---|---|---|---|---|
| 115 | 80.5 | 5.8 | 0.50 | 3.5 | — | 100 | — | 53100 | 142000 | 26500 | 2130 | 0.0132 | 6840 | 262 | 3.7 |
| 123 | 80.2 | 7.5 | 0.30 | 2.0 Mn | 0.2 Sn | 800 | 450, 2 | 65500 | 164800 | 27600 | 2420 | 0.0113 | 6270 | 258 | 3.3 |
| 131 | 79.6 | 7.0 | 0.45 | 3.5 | — | 400 | — | 72300 | 153000 | 23800 | 2160 | 0.0074 | 7030 | 260 | 3.4 |

TABLE 4(b)-continued

| Alloy No. | Composition (%) remainder (Fe) Ni | Nb | Be | V | Sc | Cooling speed from 600° C. after heating at 1250° C. (°C./hr) | Reheating temperature (°C.) time | Initial permeability μo | Maximum permeability (μm) | Effective permeability μe (1 KHz) | Magnetic residual flux density (G) | Coercive force (Oe) | Saturated magnetic flux density (G) | Vickers hardness Hv | Abrasion wear (μm) |
|---|---|---|---|---|---|---|---|---|---|---|---|---|---|---|---|
| 138 | 79.9 | 5.7 | 0.20 | 2.0 Ge | 0.6 Sb | 240 | — | 84100 | 177000 | 26400 | 2750 | 0.0058 | 6820 | 253 | 4.5 |
| 145 | 79.3 | 4.6 | 0.40 | 3.0 | — | 240 | — | 52700 | 121000 | 22500 | 2180 | 0.0083 | 7350 | 237 | 6.8 |
| 152 | 80.0 | 6.5 | 0.10 | 1.5 Si | 0.6 B | 400 | 430, 1 | 71800 | 154000 | 26000 | 2250 | 0.0060 | 6730 | 250 | 5.9 |
| 160 | 82.1 | 5.0 | 0.30 | 2.2 | — | 400 | — | 31000 | 93500 | 19600 | 2270 | 0.0159 | 7560 | 235 | 5.0 |
| 169 | 81.6 | 4.8 | 0.15 | 1.0 Co | 0.2 Mn | 240 | — | 45300 | 121000 | 21700 | 2530 | 0.0120 | 7330 | 238 | 5.4 |
| 178 | 76.4 | 10.7 | 0.05 | 3.5 | — | 240 | — | 25700 | 86000 | 18500 | 2060 | 0.0154 | 6520 | 247 | 4.5 |
| 186 | 74.3 | 5.2 | 0.40 | 1.8 Cu | 2.0 Mo | 240 | 480, 1 | 54900 | 117200 | 23900 | 2180 | 0.0106 | 7180 | 251 | 4.7 |
| 192 | 73.0 | 6.0 | 0.30 | 5.0 | — | 400 | — | 68900 | 124100 | 26500 | 2310 | 0.0092 | 6340 | 237 | 7.6 |
| 200 | 74.5 | 8.5 | 0.15 | 2.2 | 1.5 | 100 | — | 85300 | 172000 | 31000 | 2270 | 0.0063 | 6120 | 255 | 3.4 |
| Permalloy | 78.5 | — | — | — | — | *200 | — | 8000 | 86000 | 3700 | 4600 | 0.0550 | 10600 | 110 | 92.5 |

*°C./second

Figure 2:
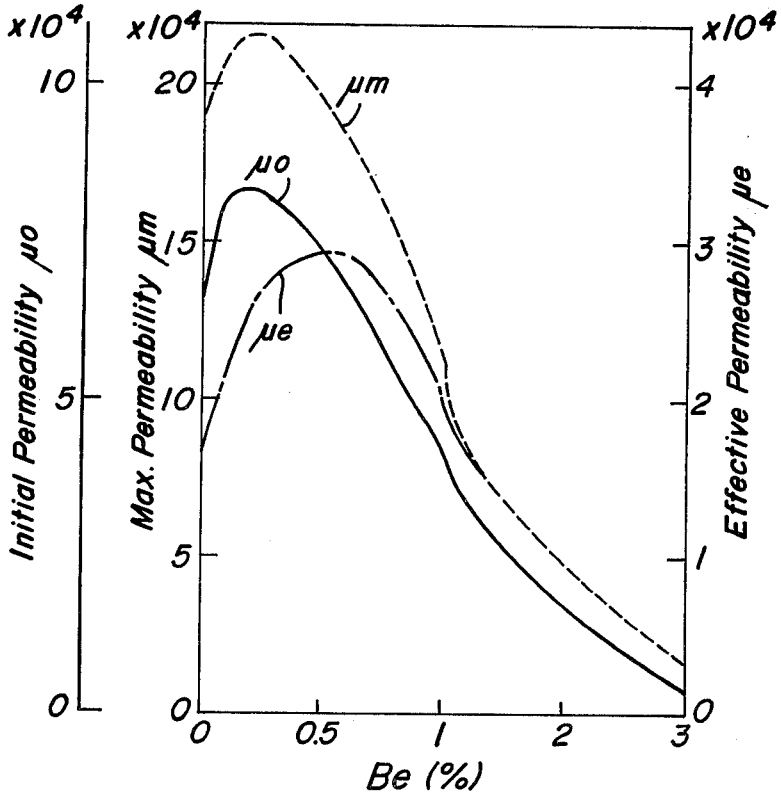
FIG. 2 is a graph showing the relation between a content of beryllium in the same alloy, an initial permeability, a maximum permeability and an effective permeability at 1 KHz.

Further, the relation between the content of beryllium in the alloy according to the invention, a permeability, a hardness and an abrasion wear will be explained with reference to the accompanying drawings in detail. FIG. 1 shows the relation of the content of beryllium, the hardness and the abrasion wear of 79.5%, Ni-Fe-7% Nb-Be alloy. In general, when a content of beryllium is increased, the hardness is remarkably increased and the abrasion wear is simultaneously decreased, and it is particularly understood that addition of a small amount of beryllium is extremely effective. FIG. 2 shows the relation between a content of beryllium, an initial permeability, a maximum permeability and a effective permeability in the same alloy as shown in FIG. 1. In general, the addition of beryllium has an effect of increasing the initial permeability, the maximum permeability and the effective permeability, and more particularly, its effect is very large in the effective permeability in an alternative current magnetic field which is important for the characteristic feature of a magnetic head. However, if more than 3% of beryllium is added, the forging and working become difficult, and the magnetic characteristic becomes improper as magnetic alloy for magnetic heads.

The reason why the alloy according to the present invention can have such high hardness is that a niobium particle is precipitated into a matrix of solid solution of Ni-Fe alloy and hardened it due to the effect of niobium and an Nb-Be series intermetallic compound having extremely high hardness is precipitated into the matrix of Ni-Fe series alloy due to the addition of beryllium.

In addition, in the above experiments, highly pure metals were used as the starting material, but it is preferabe to use ferroalloy available on the market or any kind of mother alloys as a substitute therefor. In this case, the alloy becomes brittle to some extent, so that when melting, the alloy is sufficiently deoxidized and desulfurized with the use of manganese, silicon, aluminum, titanium, boron, rare earth metal, calcium alloy, magnesium alloy, and other deoxidizing agent and desulfurizing agent in proper amount, so as to give the alloy a forgeability, a hot workability, a cold workability, a ductility and a free cutting ability.

The magnetic alloy for the use of magnetic head, in view of the sensitivity of magnetic recording and reproduction, requires more than 3,000 of effective permeability at 1 KHz and more than 3,000 G of saturated magnetic flux density, but the alloy according to the invention has more than 3,000 of the effective permeability at 1 KHz and more than 3,000 G of saturated magnetic flux density, so that it is suitable as magnetic alloy for the use of magnetic head.

In short, the alloy according to the invention is an alloy consisting of Ni, Fe, Nb and Be or adding by weight 0.01–10% in total amount of at least one element selected from the group consisting of Mo, Cr, W, Ti, V, Mn, Ge, Zr, rare earth metal, Ta, B, Al, Si, Sn, Sb, Co and Cu thereto, having high initial permeability, high maximum permeability, high effective permeability, high hardness and high workability, so that it is very suitable as an alloy for the use of magnetic recording and reproducing head, and as magnetic material for the use of common electric machinery and tools.

Next, in the present invention, the reason why the composition of the alloy is limited to 70–86% of nickel, more than 1% and less than 14% of niobium, 0.001–3% of beryllium and the remainder iron, as main ingredients, and 0.01–10% of total amount of subingredients selected from the group consisting of not more than 8% of molybdenum, not more than 7% of chromium, not more than 10% of tungsten, not morthan 7% of titanium, not more than 7% of vanadium, not more than 10% manganese, not more than 7% of germanium, not more than 5% of zirconium, not more than 2% of rare earth metal, not more than 10% of tantalum, not more than 1% of boron, not more than 5% of aluminum, not more than 5% of silicon, not more than 5% of tin, not more than 5% of antimony, not more than 10% of cobalt and not more than 10% of copper is, as apparent from Table 4 and the drawings, due to the fact that the permeability and hardness within the range of the composition are quite high and the workability is quite excellent, but if the composition is outside the range, the values of the permeability and the hardness become low and the working becomes very difficult, thereby it become improper to use as a material for the magnetic recording and reproducing head. That is, in case of the addition of less than 1% of niobium and not more than 0.001% of beryllium, the hardness is low such as less than 130, while in case of the addition of more than 14% of niobium and more than 3% of beryllium, the hardness becomes quite high, and as a result, the forgeability and the workability become difficult and the permeability is lowered. If more than 8% of molybdenum, more than 7% of chromium, more than 10% of tungsten, more than 7% of titanium, more than 10% of vanadium, more than 10% manganese, more than 7% of germanium, more than 2% of rare earth metal, more than 10% of cobalt and more than 10% of copper are added, respectively, the initial permeability becomes less than 3,000 and the maximum permeability becomes less than 5,000. If more than 5of zirconium, more than 10% of tantalum, more than 1% of boron, more than 5% of aluminum, more than 5% of silicon, more than 5% of tin and more than 5% of antimony are added, respectively, the forgeability or workability is deteriorated.

It is apparent that the present invention is not restricted to the aforesaid embodiment and example, and numerous alternations and modifications are possible without departing from the scope of the invention as hereinafter claimed.

What is claimed is:

1. A magnet alloy useful for a magnetic recording and reproducing head consisting of by weight 70 to 86% of nickel, more than 1% and less than 14% of niobium, 0.001 to 3% of beryllium, the remainder of iron and a small amount of impurities, said magnet alloy having initial permeability of more than 3,000, maximum permeability of more than 5,000, and Vickers hardness of more than 130.

2. A magnet alloy useful for a magnetic recording and reproducing head consisting of by weight 73 to 85% of nickel, more than 1% and less than 10% of niobium, 0.01 to 2% of beryllium, the remainder iron and a small amount of impurities, said magnet alloy having initial permeability of more than 3,000, maximum permeability of more than 5,000, and Vickers hardness of more than 130.

3. A method of manufacturing a magnet alloy useful for a magnetic recording and reproducing head consisting essentially of by weight 70 to 86% of nickel, more than 1% and less than 14% of niobium, 0.001 to 3% of beryllium, the remainder iron and a small amount of impurities, characterized in that which comprises the step of heating the alloy at a temperature of more than 600° C. and lower than the melting point in a nonoxidizing atmosphere or vacuum for at least more than 1 minute and less than 100 hours corresponding to the composition, and cooling it to a room temperature from the temperature of more than order-disorder transformation point of about 600° C. at a suitable cooling rate of 100° C./second to 1° C./hour corresponding to the composition.

4. A method of manufacturing a magnet alloy useful for a magnetic recording and reproducing head consisting essentially of by weight 70 to 86% of nickel, more than 1% and less than 14% of niobium, 0.001 to 3% of beryllium, the remainder iron and a small amount of impurities, characterized in that, which comprises: heating said alloy at a temperature of more than 600° C. and lower than a melting point in a nonoxidizing atmosphere or vacuum for at least more than 1 minute and less than 100 hours corresponding to the composition, cooling it to a room temperature from the temperature of more than the order-disorder transformation point of about 600° C. at a suitable cooling rate of 100° C./second to 1° C./hour corresponding to the composition, and further heating it at a temperature of less than the order-disorder transformation point of about 600° C. in a nonoxidizing atmosphere or vacuum for at least more than 1 minute and less than 100 hours corresponding to the composition and cooling it to a room temperature.

5. A magnet alloy useful for a magnetic recording and reproducing head consisting of by weight 70 to 86% of nickel, more than 1% and less than 14% of niobium, and 0.001 to 3% of beryllium as main ingredients and 0.01 to 10% of tottal amount of subingredients selected from the group consisting of not more than 8% of molybdenum, not more than 7% of chromium, not more than 10% of tungsten, not more than 7% of titanium, not more than 7% of vanadium, not more than 10% of manganese, not more than 7% of germanium, not more than 5% of zirconium, not more than 2% of rare earth metal, not more than 10% of tantalum, not more than 1% of boron, not more than 5% of aluminum, not more than 5% of silicon, not more than 5% of tin, not more than 5% of antimony, not more than 10% of cobalt and not more than 10% of copper, the remainder of iron and a small amount of impurities, said magnet alloy having initial permeability of more than 3,000, maximum permeability of more than 5,000, and Vickers hardness of more than 130.

6. A magnet alloy as claimed in claim 5, wherein the alloy consists of by weight 73 to 85% of nickel, more than 1% and less than 10% of niobium, and 0.01 to 2% of beryllium as main ingredients and 0.01 to 10% of total amount of subingredients selected from the group consisting of not more than 6% of molybdenum, not more than 5% of chromium, not more than 7% of tungsten, not more than 5% of titanium, not more than 4% of vanadium, not more than 7% of manganese, not more than 5% of germanium, not more than 3% of zirconium, not more than 1% of rear earth metal, not more than 7% of tantalum, not more than 0.7% of boron, not more than 3% of tin, not more than 3% of antimony, not more than 7% of cobalt and not more than 7% of copper, the remainder of iron and a small amount of impurities.

7. A magnet alloy as claimed in claim 5, wherein the alloy consists of by weight 70 to 86% of nickel, more than 3% and less than 14% of niobium, and 0.01 to 2% of beryllium as main ingredients and 0.01 to 10% of total amount of subingredients selected from the group consisting of not more than 8% of molybdenum, not more than 7% of chromium, not more than 10% of tungsten, not more than 7% of titanium, not more than 7% of vanadium, not more than 10% of manganese, not more than 7% of germanium, not more than 5% of zirconium, not more than 2% of rare earth metal, not more than 10% of tantalum, not more than 1% of boron, not more than 5% of aluminum, not more than 5% of silicon, not more than 5% of tin, not more than 5% of antimony, not more than 10% of cobalt and not more than 10% of copper, the remainder of iron and a small amount of impurities.

8. A magnet alloy useful for a magnetic recording and reproducing head consisting essentially of by weight 73 to 85% of nickel, more than 1% and less than 10% of niobium, and 0.01 to 2% of beryllium as main ingredients and 0.01 to 10% of a total amount of subingredients selected from the group consisting of not more than 6% of molybdenum, not more than 5% of chromium, not more than 7% of tungsten, not more than 5% of titanium, not more than 4% of vanadium, not more than 7% of manganese, not more than 5% of germanium, not more than 3% of zirconium, not more than 1% of rare earth metal, not more than 7% of tantalum, not more than 0.7% of boron, not more than 3% of aluminum, not more than 3% of silicon, not more than 3% of tin, not more than 3% of antimony, not more than 7% of cobalt and not more than 7% of copper, the remainder of iron and a small amount of impurities, said magnet alloy having initial permeability of more than 3,000, maximum permeability of more than 5,000, effective permeability of more than 3,000, and Vickers hardness of more than 130.

* * * * *